United States Patent [19]

Herrmann, Jr. et al.

[11] 4,455,056

[45] Jun. 19, 1984

[54] MULTI-PIN HIGH VOLTAGE CONNECTOR

[75] Inventors: Henry O. Herrmann, Jr., Elizabethtown; Reuben E. Ney, Mt. Joy, both of Pa.

[73] Assignee: AMP Incorporated, Harrisburg, Pa.

[21] Appl. No.: 371,406

[22] Filed: Apr. 26, 1982

Related U.S. Application Data

[63] Continuation of Ser. No. 142,941, Apr. 23, 1980, abandoned.

[51] Int. Cl.[3] ..... H01R 13/50; H01R 13/53

[52] U.S. Cl. ..... 339/91 R; 339/49 R; 339/103 C; 339/211

[58] Field of Search ..... 339/47 R, 49 R, 59 R, 339/59 M, 60 M, 107, 66 R, 66 M, 176 M, 211, 103 C, 186 R, 186 M

[56] References Cited

U.S. PATENT DOCUMENTS

| | | | |
|---|---|---|---|
| 2,928,998 | 3/1960 | Brumfield | 339/186 M |
| 3,055,971 | 9/1962 | Lander | 339/103 M |
| 3,173,734 | 3/1965 | Hartwell | 339/49 |
| 3,178,669 | 4/1965 | Roberts | 339/49 |
| 3,293,591 | 12/1966 | Mayer, Jr. | 339/107 |
| 3,745,512 | 7/1973 | Johnson et al. | 339/59 M |
| 3,824,524 | 7/1974 | Glover | 339/60 R |

*Primary Examiner*—Neil Abrams
*Attorney, Agent, or Firm*—Russell J. Egan

[57] ABSTRACT

An improved multi-pin high voltage connector is disclosed. The connector is easy to assemble and use, is low in cost and can withstand on the order of ten thousand mating cycles. It also has recessed contacts so that it is substantially impossible to make accidental engagement with the contacts in either the mated or unmated condition. The contact isolation is provided by intermating egg crate walls on both the plug and receptacle members which are received in grooves in the opposite member. This also provides an extremely long creepage path.

17 Claims, 9 Drawing Figures

Fig. 3
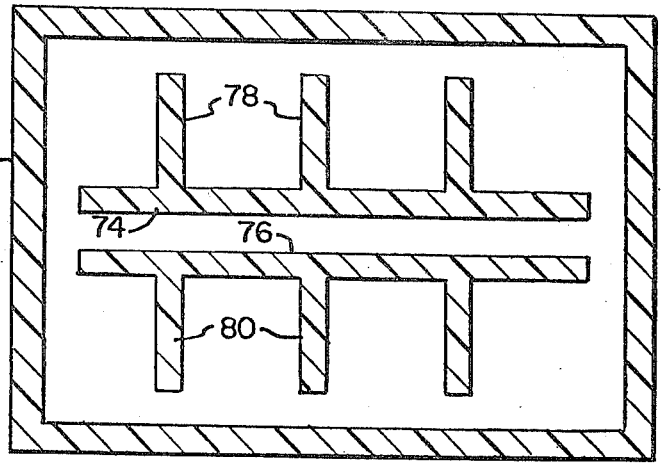
Fig. 2
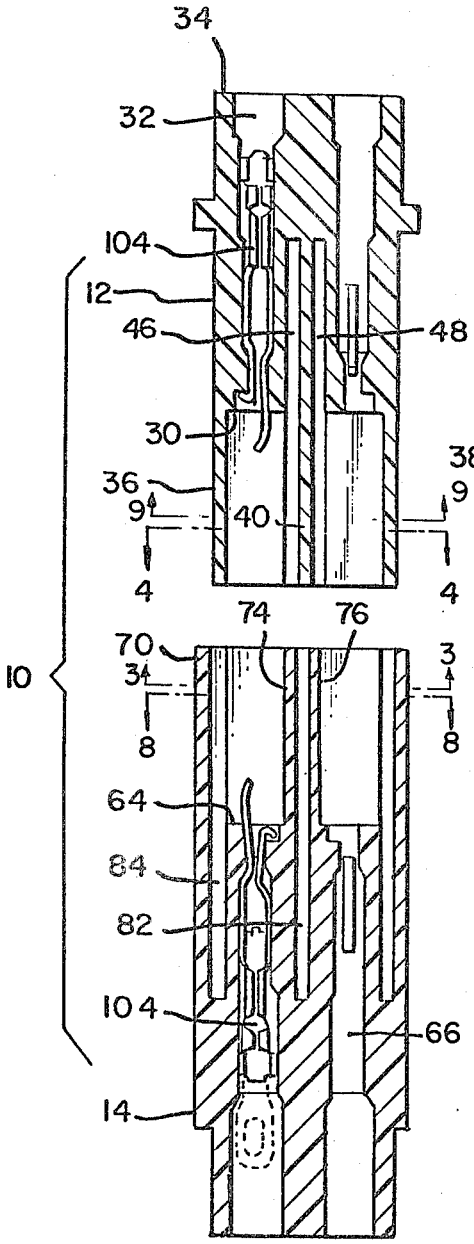
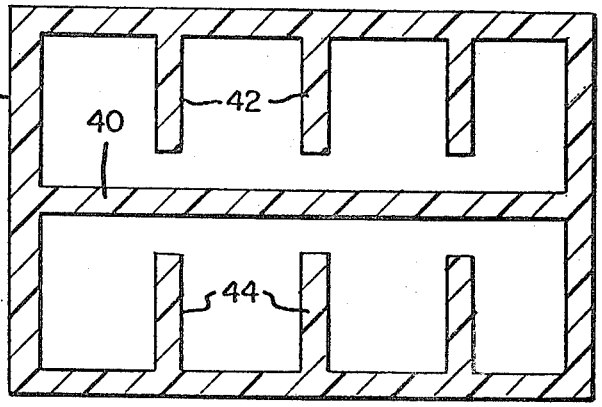
Fig. 4
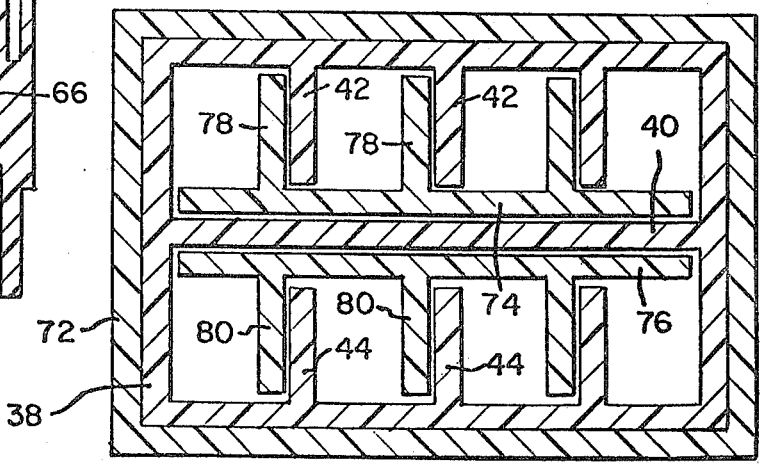
Fig. 5

Fig. 6
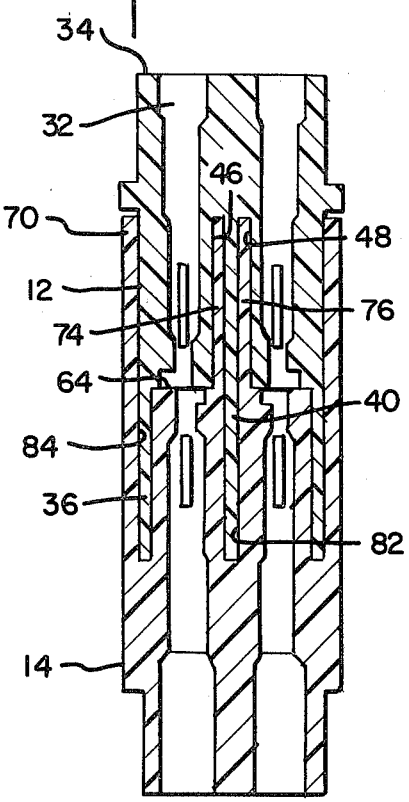
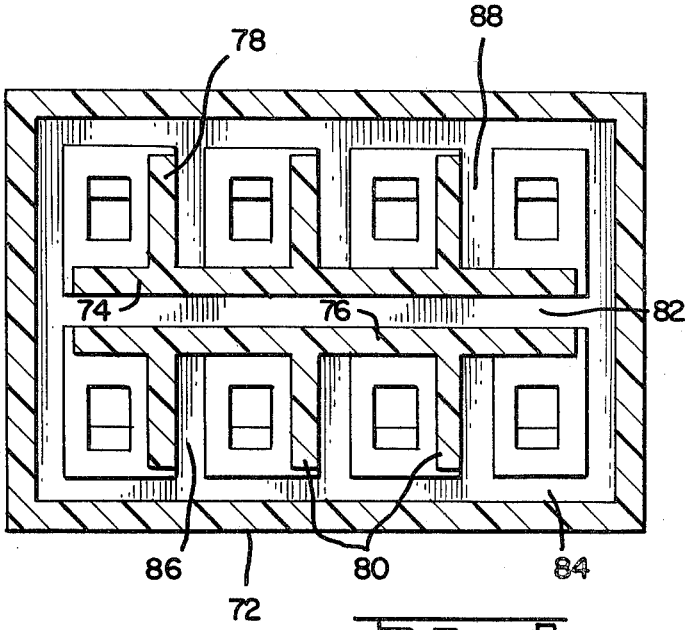
Fig. 8
Fig. 7
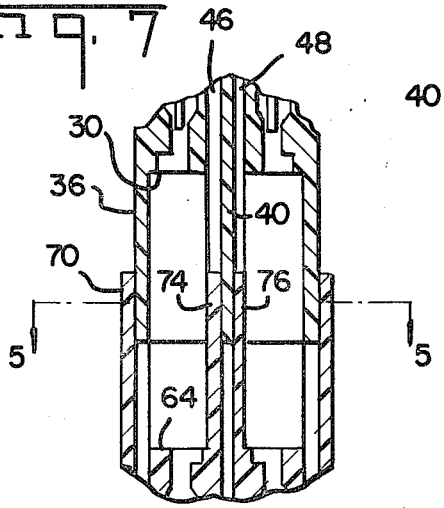
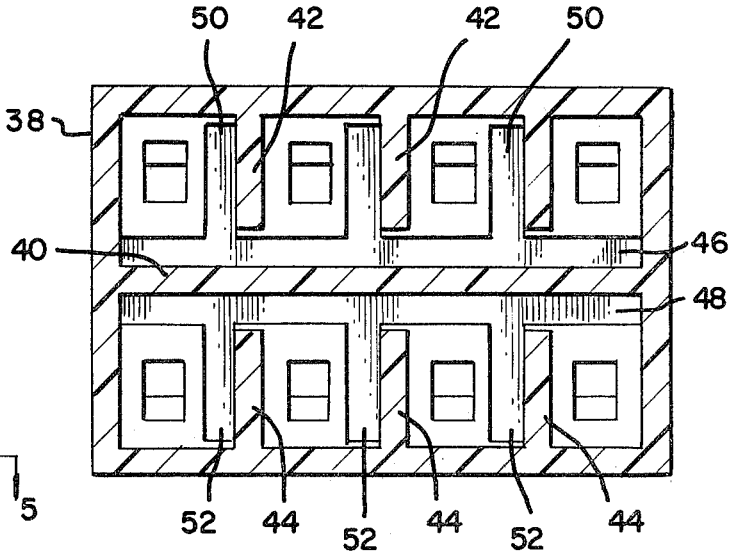
Fig. 9

MULTI-PIN HIGH VOLTAGE CONNECTOR

This is a continuation of application Ser. No. 142,942 filed Apr. 23, 1980 now abandoned.

BACKGROUND OF THE INVENTION

1. The Field of the Invention

The present invention relates to a multi-pin high voltage connector and in particular to a connector in which accidental engagement with the contacts in either the mated or unmated condition is prevented.

2. The Prior Art

There have been many difficulties encountered with the prior art electrical connectors which are in high usage areas. Amongst these difficulties are fairly ready accessibility to the contacts, in the mated and/or unmated condition, inadequate clearance and creepage distance and less than five hundred mating cycles. Examples of these electrical connectors are those used with instrumentation and test equipment, such as voltmeters, power supplies and data acquisition systems.

SUMMARY OF THE INVENTION

The present invention comprises one piece plug and receptacle members, each member having an egg crate like shroud projecting from a mating face and enclosing terminals extending from said mating face. The egg crate extensions are interfitting and received in recesses in the mating face of the opposite member to form an extremely long creepage path. The receptacle is arranged for both bulkhead mounting and free hanging interconnection. Both the plug and receptacle are adapted to accept a snap-on strain relief member providing strain relief for the accompanying conductors at either straight on or right angle entry to the respective connector member.

It is therefore an object of the present invention to produce an improved connector having one piece construction which provides positive contact latching and positioning.

It is another object of the present invention to produce a one piece electrical connector having a long creepage path.

It is another object of the present invention to produce an improved electrical connector which will withstand greater than ten thousand mating cycles through choice of contacts, the latching spring and protecting shroud design, and the fact that there are no close fitting high wear features on the connectors.

It is yet another object of the present invention to produce an improved electrical connector in which the contacts for both the plug and receptacle members are sufficiently recessed that unintentional engagement therewith, in either the mated or unmated condition, is substantially impossible.

It is a further object of the present invention to produce a one piece construction plug and receptacle for an electrical connector which plug and receptacle can be readily and economically manufactured.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 2 is an exploded longitudinal section through the plug and receptacle members of the present invention;

FIG. 3 is an instantaneous section through the shroud of the plug member according to the present invention;

FIG. 4 is an instantaneous section through the shroud of the receptacle portion of the present invention;

FIG. 5 is an instantaneous section taken along line 5—5 of FIG. 8 showing the intermating of the shrouds of plug and receptacle members according to the present invention;

FIG. 6 is a section similar to FIG. 2 showing the connector members in the mated condition;

FIG. 7 is a detailed section through the shroud portions of the beginning of mating;

FIG. 8 is a section through the plug member at the mating face; and

FIG. 9 is a section through the receptacle member at the mating face.

DETAILED DESCRIPTION OF THE PREFERRED EMBODIMENT

Figure 1:
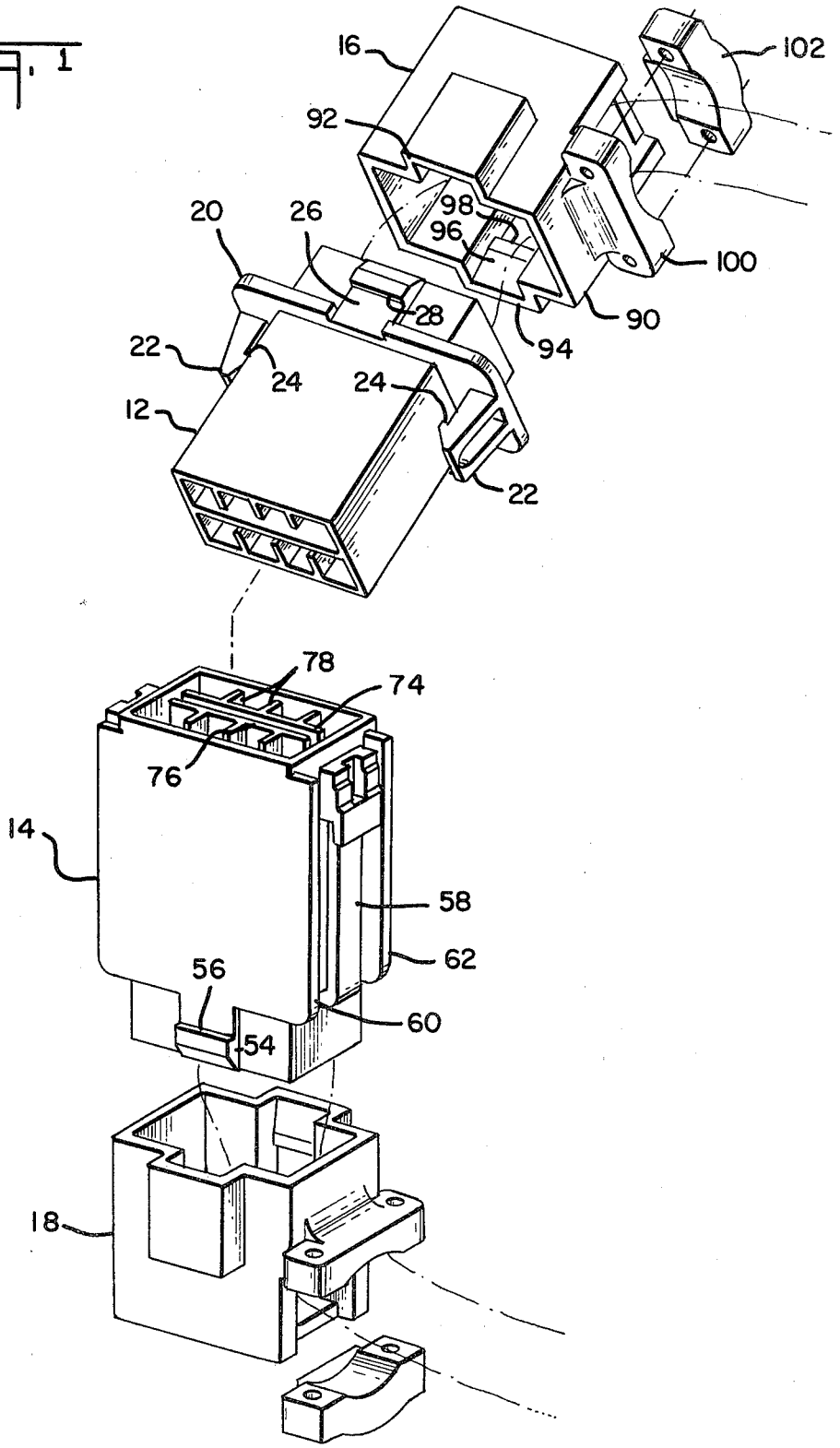
FIG. 1 is an exploded perspective view of the subject electrical connector.

The subject connector 10 includes a one piece receptacle member 12, a one piece plug member 14, and a pair of identical strain relief members 16, 18. The receptacle member 12 is a generally rectangular member having an outwardly directed, peripherial mounting flange 20 towards one end. A pair of latching lugs 22 extend in a first direction from the ends of the flange and having cam ramps leading to shoulders 24 inwardly directed towards the receptacle. A second pair of lugs 26 extend in the opposite direction from the opposite sides of flange 20 and have can ramps defining outwardly directed shoulders 28. The receptacle member 12 has a mating face 30 with a plurality of contact passages 32 extending from the rear wall 34 of the housing to the mating face 30. A shroud 36 extends from and encloses the mating face. The shroud has a complete peripherial wall 38 and is divided into a plurality of segments by a transverse wall 40 and a plurality of inwardly directed sidewalls 42, 44 which extend towards but do not engage the transverse wall 40, as best seen in FIG. 4. On both sides of the transverse wall there are central grooves 46, 48 extending into the mating face 30 as best seen in FIG. 9. Likewise there are a plurality of lateral grooves 50, 52 extending sidewards from each central groove.

The plug 14 is likewise a generally rectangular member having a pair of outwardly directed lugs 54 on each side towards one end, each lug having an outwardly directed can surface leading up to a shoulder 56. On the ends of the plug member there are a pair of cantilever latching members 58 adapted to latchingly engage lugs 22. The latching members 58 are protected against unintentional disengagement from the latching lug 22 by integral side flanges 60, 62. The plug has a mating face 64 with a plurality of terminal passages 66 extending between a rear wall 68 and the mating face 64. The mating face is enclosed by an egg crate shroud 70 including a complete peripherial wall 72 and central lateral walls 74, 76 each of which has a plurality of sidewalls 78, 80, all of the central and sidewalls being free standing with respect to the peripheral wall, as best seen in FIG. 3. The mating face 64 has a centrally disposed transverse groove 82, a peripherial groove 84 and a plurality of side grooves 86, 88 bextending inwardly of the peripherial groove, as best seen in FIG. 8.

The strain relief members 16, 18 are identical and are shown in a right angle version. It is to be understood that a straight in version could equally be included within the scope of the invention. The strain relief member includes a housing 90 having a pair of inwardly directed opposite side channels 92, 94 which are aligned with the respective lugs 26, 54 of the receptacle and plug members respectively. Each channel includes a camming ramp 96 culminating in a rearwardly directed latching shoulder 98. A clamping member comprising a profiled integral flange 100 and a detachable profiled member 102 are positioned to one side or to the rear of the housing 90. The clamp 102 is held against the clamp 100 by conventional bolts or screws (not shown).

The terminals 104 are of a well known type and are described in U.S. Pat. No. 3,178,669, the disclosure of which is incorporated herein by reference. It should be noted that the subject invention may be used with either the crimped on version or the soldered on version of the terminal as disclosed in the patent. It will also be noted, from FIG. 2, that because of the design of the subject housings that it is substantially impossible to make unintended contact with the terminals in an unmated condition of the connector.

The connector is assembled in the conventional manner by first terminating the terminals 104 and then inserting them into the profiled passageways 32, 66 of the plug and receptacle members respectively.

The receptacle is designed to be either panel mountedor to be freely assembled in the manner shown in FIG. 1. If the receptacle 12 is to be panel mounted, it would be inserted into an aperture in the panel and secured by either bolts or rivets. It would be possible to mount the receptacle from the front or rear of a panel although this would require different shapes of aperture in the panel to receive the connector.

The strain relief would be applied in the expected manner by running the conductors through the opening between the clamping members. The strain relief would then be snap fitted onto the rear of the plug or receptacle with the lugs 26 or 54 engaging on the shoulder 98 to securely hold the strain relief in place. Then the clamping members would be secured against the conductors.

The mating of the subject connector can best be understood from FIG. 2. The plug and receptacle are first aligned and then brought together with the transverse wall 40 of the receptacle 12 passing between the transverse walls 74, 76 of the plug, as will be seen in FIGS. 5 and 7. The sidewalls 42, 44, 78, 80 pass immediately adjacent one another and into the transverse grooves in each mating face so that the terminals 104 will finally engage.

The connector 10 is shown in FIG. 6 in the fully mated condition with mating faces 30, 64 engaging and shrouds 36, 70 received in their respective grooves.

The present invention may be subject to many modifications and changes without departing from the spirit or essential characteristics thereof. The present embodiment should therefore be considered in all respects as illustrative and not restrictive of the scope of the invention.

What is claimed is:

1. An electrical connector comprising:

a plug and a receptacle mateable with each other, each said plug and said receptacle having a housing defining a mating face, each said housing having a plurality of contact passages opening onto said mating face, each said housing having a shroud extending from said mating face including a first closed peripherial wall and a plurality of second walls extending from said mating face within said first wall defining a plurality of adjacent pairs of walls extending normal to each other formingartial individual contact compartments coaxial with and on first and second sides of each respective contact passage, said plug first wall enclosing the receptacle first wall throughout the full peripherial extent of the plug and receptacle when mated, a patterned array of grooves in each said mating face, said grooves being in adjacent pairs extending normal to each other and lying on third and fourth sides of each respective contact passage, each said groove aligned to receive a respective wall of said shroud of the opposite housing, at least one of said adjacent pairs of normally extending walls or grooves being interconnected and an electrical terminal mounted in each said passage projecting from said mating face but not beyond said shroud, whereby in an unmated condition said shrouds substantially enclose each terminal which is recessed within said shrouds making it impossible to make contact with said terminals and in a mated condition said first and second walls interfit with respective grooves of the opposite housing to form an extremely long creepage path for each terminal.

2. An electrical connector according to claim 1 further comprising: d latching means to latchingly engage said plug and said receptacle.

3. An electrical connector to claim 1 further comprising:

means to mount said receptacle member in an aperture of a panel.

4. An electrical connector according to claim 1 further comprising:

strain relief means snap fitted to the respective housing.

5. An electrical connector according to claim 1 wherein each said housing is formed of a single piece of insulative material.

6. An electrical connector according to claim 1 wherein each said terminal is hermaphroditic and at least a portion thereof extends from said mating face but not beyond said shroud.

7. An electrical connector plug comprising:

a housing defining a mating face, a plurality of contact passages opening onto said mating face, a shroud extending from said mating face and including a first closed peripherial wall uninterruptedly encompassing said mating face and adapted to receive a receptacle therein in a mated condition and a plurality of second walls extending from said mating face within said first wall and defining a plurality of adjacent pairs of walls extending normal to each other forming partial individual contact compartments each of which is coaxial with and on first and second sides of a respective contact passage, a patterned array of grooves in said mating face, said grooves being in adjacent pairs extending normal to each other and lying on third and fourth sides of each respective contact passage each said groove lying adjacent a wall of said shroud and being adapted to receive therein a corresponding wall of a shroud of a mating receptacle member, at least one of said adjacent pairs of normally extending walls or grooves being interconnected and a like plurality of electrical terminals each terminating a respective conductor and mounted in a respective contact passage wherein in an unmated condition said shroud substantially encloses each terminal which is recessed within making it impossible to make contact with said terminals and in a mated condition said walls are received in grooves in a mating connector to form an extremely long creepage path.

8. An electrical plug according to claim 7 further comprising:

latching means to latchingly engage said plug with a receptacle.

9. An electrical connector plug according to claim 7 further comprising:

strain relief means snap fitted to a rear portion of said housing.

10. An electrical connector plug according to claim 7 wherein said housing is formed of a single piece of insulative material.

11. An electrical connector plug according to claim 7 wherein each said terminal is hermaphroditic and at least a portion thereof extends from said mating face but not beyond said shroud.

12. An electrical connector receptacle comprising:

a housing defining a mating face, a plurality of contact passages opening onto said mating face, a shroud extending normal from said mating face including a first closed peripherial wall uninterruptedly encompassing said mating face and adapted to be received within a shroud of a mating plug member and a plurality of second walls extending from said mating face within said first wall defining a plurality of adjacent pairs of walls extending normal to each other forming partial individual contact compartments coaxial with and on first and second sides of each respective contact passage, a patterned array of grooves in said mating face, said grooves being in adjacent pairs extending normal to each other and lying on third and fourth sides of each respective contact passage, each said groove lying adjacent a wall of said shroud and being adapted to receive therein a corresponding wall of a shroud of a mating connector member; at least one of said adjacent pairs of normally extending walls or grooves being interconnected and a like plurality of electrical terminals each terminating a respective conductor and mounted in a respective contact passage, whereby in an unmated condition said shroud substantially enclosed each terminal which is recessed within making it impossible to make contact with terminals and in a mated condition said walls mate with recesses in the other member to form an extremely long creepage path.

13. An electrical connector receptacle according to claim 12 further comprising:

latching means to latchingly engage said receptacle with a plug.

14. An electrical connector receptacle according to claim 12 further comprising:

means to mount said receptacle member in an aperture of a panel.

15. An electrical connector receptacle according to claim 12 further comprising:

strain relief means snap fitted to a rear portion of said housing.

16. An electrical connector receptacle according to claim 12 wherein said housing is formed of a single piece of insulative material.

17. An electrical connector receptacle according to claim 12 wherein each said terminal is hermaphroditic and at least a portion thereof extends from said mating face but not beyond said shroud.

* * * * *